United States Patent [19]

Vöhringer

[11] Patent Number: 5,054,525

[45] Date of Patent: Oct. 8, 1991

[54] DOUBLE LAYER FORMING WIRE FABRIC

[75] Inventor: Fritz Vöhringer, Heidenheim, Fed. Rep. of Germany

[73] Assignees: F. Oberdorfer GmbH & Co.; KG Industriegewebe-Technik, Fed. Rep. of Germany

[21] Appl. No.: 370,447

[22] Filed: Jun. 23, 1989

[51] Int. Cl.[5] ..... D03D 13/00

[52] U.S. Cl. ..... 139/383 A; 139/413; 139/425 A

[58] Field of Search ..... 139/383 A, 425 A, 408, 139/413

[56] References Cited

U.S. PATENT DOCUMENTS

| | | | |
|---|---|---|---|
| 4,499,927 | 2/1985 | Borel | 139/383 A |
| 4,564,051 | 1/1986 | Odenthal | 139/383 A |
| 4,821,780 | 4/1989 | Tate | 139/383 A |

*Primary Examiner*—Andrew M. Falik

*Attorney, Agent, or Firm*—Gifford, Groh, Sprinkle, Patmore and Anderson

[57] ABSTRACT

A double fabric produced by a forming wire for the wet end of a paper making machine. The double fabric has two sets of longitudinally directed threads and at least one upper and one lower layer of cross threads. The first set of longitudinal threads are woven with the upper layer cross threads. The second set is woven with the lower layer of cross threads, as well as partly with the upper layer to form a woven pattern.

21 Claims, 3 Drawing Sheets

Fig-4
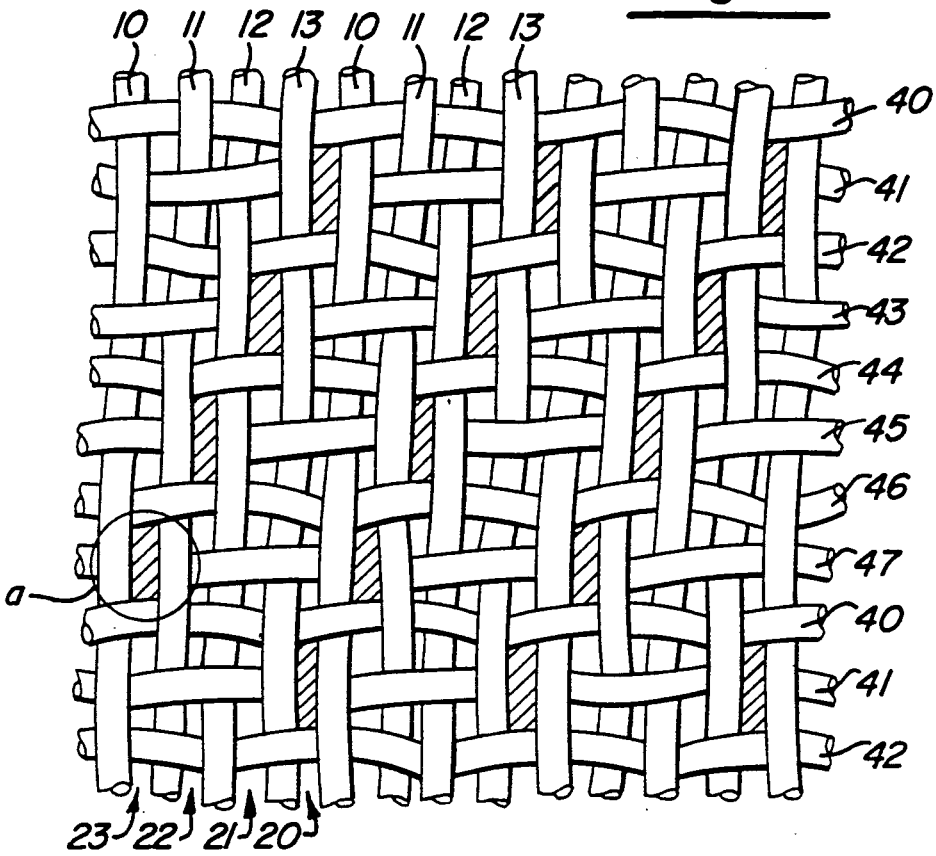
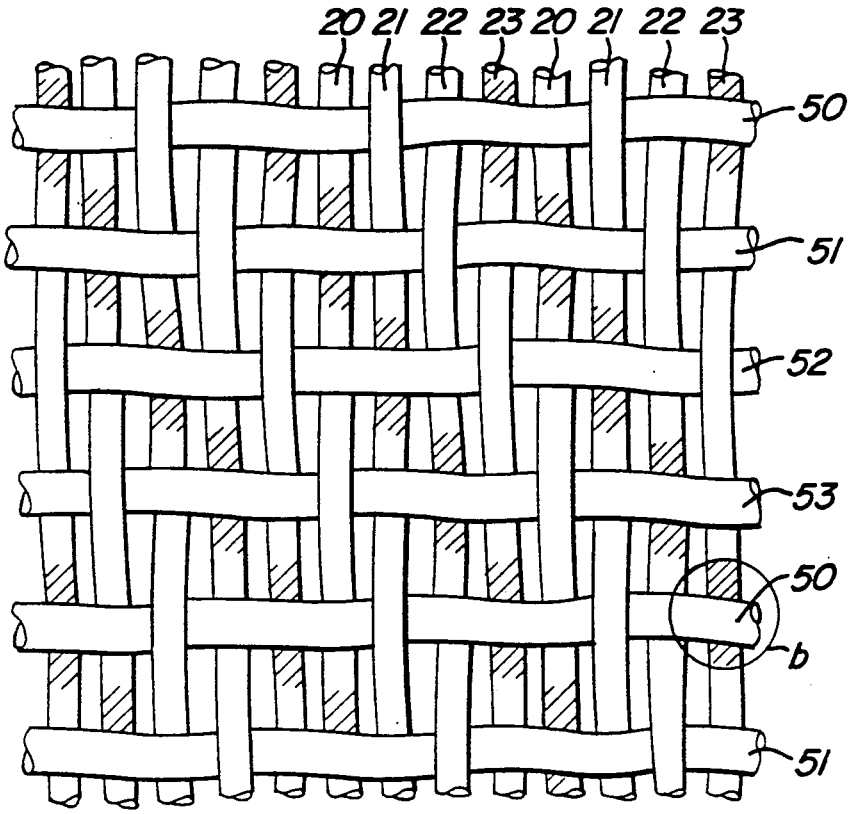
Fig-5

DOUBLE LAYER FORMING WIRE FABRIC

BACKGROUND OF THE INVENTION

The invention relates to a double fabric as forming wire for the wet end of a papermaking machine.

As commonly known forming wires of such kind have to fulfill functions with respect to stability, uniformity of water permeability, smoothness of surface, number of meshes per cm. and other requirements. Moreover, a number of supporting points as great as possible on the paper side of the wire is required as well as a great wear capacity on the running side of the wire, because the surface characteristics of the papers which are to be manufactured are also dependent on the number of supporting points, whereas the life time of the wire is dependent on the wear capacity. Thus by increasing the wear capacity of the fabric the life time is increased.

DESCRIPTION OF THE PRIOR ART

In order to fulfill the above mentioned requirements for such a papermaking wire U.S. Pat. No. 3,127,308 proposes a fine upper fabric having a simple binding (linen-binding) combined with a lower fabric having a three-twill-binding so that the longitudinal threads (yarns in machine direction) of the lower fabric cross at definite points along the single cross or transverse threads (yarns in cross machine direction) of the fine, simple upper fabric. Those types of webs or wires are double fabrics or multiple fabrics connected to one another. The manufacturing of qualified double fabrics, however, has raised difficulties, because the binding of the thick longitudinal threads of a lower web into the fine upper web causes disturbances so that the manufacture of the paper without deficiencies has not been possible. Therefore, in order to avoid these deficiencies separate thin binding threads have been used for connecting the double fabrics. This, however, has raised a problem with the thin binding threads which because of the relative movements occuring between the layers of the fabric are destroyed relatively fast by abrasion. These movements are at least partly caused by the rather great thickness of the double fabric in its.

From another reference (DE-PS 30 36 309) a double-layered papermaking wire is as shown in FIG. 1. In this fabric only some of the longitudinal threads I, II, and preferrably each second longitudinal thread II are bound into both the upper layer III and the lower layer IV of the cross threads. Because of the fact that each longitudinal thread I and II takes part in the binding of the surface, i.e. the paper side of the wire, the longitudinal threads II which are bound into both layers of cross threads must be woven by a separate warp thread roll because of their greater weave length. Despite the expenditure the longitudinal threads I are not only bound into the upper layer of cross threads but are also bound into the lower layer of cross threads. This is because of the fact that the longitudinal threads are drawn downwardly during the fixing operation because of their lower binding. This effect on the paper side is such that a kind of double fabrics can only be used for types of paper which are not sensitive with respect to marking.

Therefore, it is the object underlying the invention to combine the advantages of the double layered webs which are provided with only one longitudinal thread system with the advantages of the multiple webs which are provided with at least two longitudinal thread systems to prepare a new type of web or fabric without taking over the above mentioned deficiencies.

It is another object of the present invention to provide such a papermaking wire having excellent machine-and cross-machine direction stability and long service life.

SUMMARY OF THE PRESENT INVENTION

The present invention discloses a double fabric material which is comprised of two sets of longitudinal threads. The first set of threads is interwoven only with an upper layer of cross threads, and the second set is likewise interwoven with a lower layer of cross threads. The second set of threads is also partly interwoven with the upper layer of threads. The resulting product is a repeating weave pattern with desirable characteristics.

A further embodiment of the present invention discloses upper cross threads which alternately cross under and over the first set of longitudinal threads. The pairs of cross threads are further offset with respect to one another because of the crosswise extending longitudinal threads of the first set.

Another embodiment disclosed lower cross threads undercrossing and overcrossing the longitudinal threads of the second set in a manner similar to the upper cross threads.

DESCRIPTION OF THE DRAWINGS

A better understanding of the invention will be reached by reference to the following detailed description related to the accompanying drawings in which:

FIG. 4 is a plan view of the upper layer or paper side, respectively, of the double web according to the invention, wherein the hatched parts show how and where the longitudinal threads of the second set are interwoven according to the embodiment as shown in FIG. 5;

FIG. 5 is a plan view of the lower layer or running side, respectively, of the double web according to the invention concerning the type as shown by FIGS. 2 and 4, wherein the hatched parts of the longitudinal threads of the second set overcross the cross threads of the upper layer at the hatched locations in FIG. 4 and wherein the circles a) and b) in FIGS. 4 and 5 identify the relationship or position, respectively, of the two layers;

DESCRIPTION OF THE PREFERRED EMBODIMENTS OF THE PRESENT INVENTION

Figure 1:
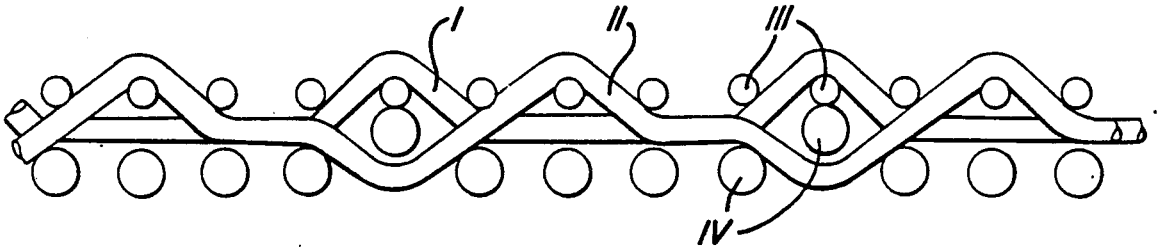
Fig-1 PRIOR ART
FIG. 1 is a sectional view in direction of the longitudinal threads of a known double-layered web in the prior art in which only a part of the longitudinal threads II are bound into the lower layer of cross threads, all longitudinal threads I and II, however, are taking part on the binding of the surface structure on the paper side.

The double web or forming fabric as shown in FIG. 1 is known in the prior art. Therefore, it is below not discussed in detail.

Figure 2:
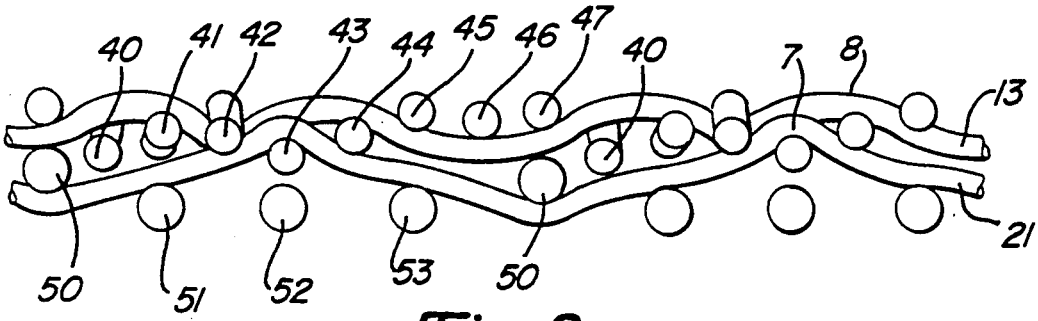
FIG. 2 is a sectional view along the longitudinal threads of the double web according to the subject invention, corresponding to the embodiments as shown by the FIGS. 4 and 5.

The forming fabric of the present invention shown in FIG. 2 in a sectional view is woven in an 8-shaft loom and is shown in FIG. 4 as plan view of the paper side and in FIG. 5 as plan view of the running side.

This fabric includes about 75 longitudinal threads per cm., consisting of polyester and having a diameter of 0.15 mm. Its upper cross threads 40 to 47 consist also of polyester and have a diameter of 0.13 to 0.15 mm. The threads are indicated at 10–13 and 20–23 (FIG. 4). The diameter of the lower cross threads 50 to 53 is 0.20 mm. or 0.22 mm., and each second cross thread may consist of polyamide.

Because of the fact that in forming wire or fabric the connection of the longitudinal threads 20 to 23; of the second set to the upper fabric is made at inwardly directed and crosswise floatings of the upper cross threads 41, 43, 45, 47, in the upper fabric no surface disturbances occur and thus no marking. The longitudinal threads 20 to 23; of the second set tangent at those points 7, at which they overcross an upper cross thread to a level which is at least 10% of the diameter of a longitudinal thread of the first set. The longitudinal threads 20 to 23 are further positioned tangentially with respect to upwardly directed floatings 8 of the longitudinal threads 10 to 13 of the fabric.

The distance between the points 7 and floatings 8 is essentially provided by the kind of the binding and not by the formation of the so-called "bowles" occuring in the known double fabrics.

This forming wire or fabric has after it has been ground a thickness of about 0.63 to 0.56 mm. and is therefore not essentially thicker than the known double-layered fabrics or webs having a corresponding fineness. Alternately, use of longer and shorter floatings of the cross threads 40 to 47 on the paper side results in a surface having only few markings, so that this surface can be very favorably covered by the fibers of the pulp and allows for a favorable distribution of the fibers thereon. Despite the relative great longitudinal thread density and the relative great number of cross threads on the paper side of about 34/cm. this forming wire has a good permeability for gas of about 2.20 per square meter-sec.

Thus, by this forming wire a construction is realized as can be gathered from FIGS. 4 and 5 which is characterized by the fact that first and second sets of longitudinal threads 10 to 13 and 20 to 23 provide with the upper layer of cross threads 40 to 47 a weave repeat, in which at least some of the above cross threads 41, 43, 45, 47 are undercrossed by five subsequently following longitudinal threads and are overcrossed thereafter by three subsequently following longitudinal threads, wherein two longitudinal threads of the last mentioned three subsequently following longitudinal threads of the first set and one longitudinal thread of that first set belong to the second set 2 and the last mentioned longitudinal thread of said second set is overcrossing only one upper cross thread within the weave pattern or repeat, whereas the longitudinal threads of the first set overcross two subsequently following upper cross threads within the weave pattern two times.

The hatched parts in FIG. 4 show with respect to FIG. 5 how and where the longitudinal threads 20 to 23 of the second set 2 arc interwoven. Here is the special embodiment realized according to which those upper cross threads 41, 43, 45, 47 which alternatively and undercross and overcross pairs of the longitudinal threads of the first set 1 are each offset with respect to one another by a longitudinal thread of the first set 1. Moreover, it can be seen that it is also possible that those upper cross threads 40, 42, 44, 46, which alternatively undercross and overcross the single longitudinal threads of the first set 1 are each offset with respect to one another by a longitudinal thread of the first set 1.

In the plan view of the underside or running side of the forming fabric as shown in FIG. 5 the hatched parts of the longitudinal threads 20 to 23 of the second set are arranged such that they overcross the cross threads 41, 43, 45, 47, of the upper layer at the hatched locations shown in FIG. 4, wherein the circles a) and b), respectively, shown in FIGS. 4 and 5 characterize the relationship or position, respectively, of the two layers with respect to one another.

Moreover, from FIG. 4 the special embodiment of the forming wire can be gathered according to which the lower cross threads 50 to 53 overspan three subsequently following longitudinal threads of the second set 2 as well as overspan all longitudinal threads of the first set 1 as seen from the underside of the fabric.

Figure 6:
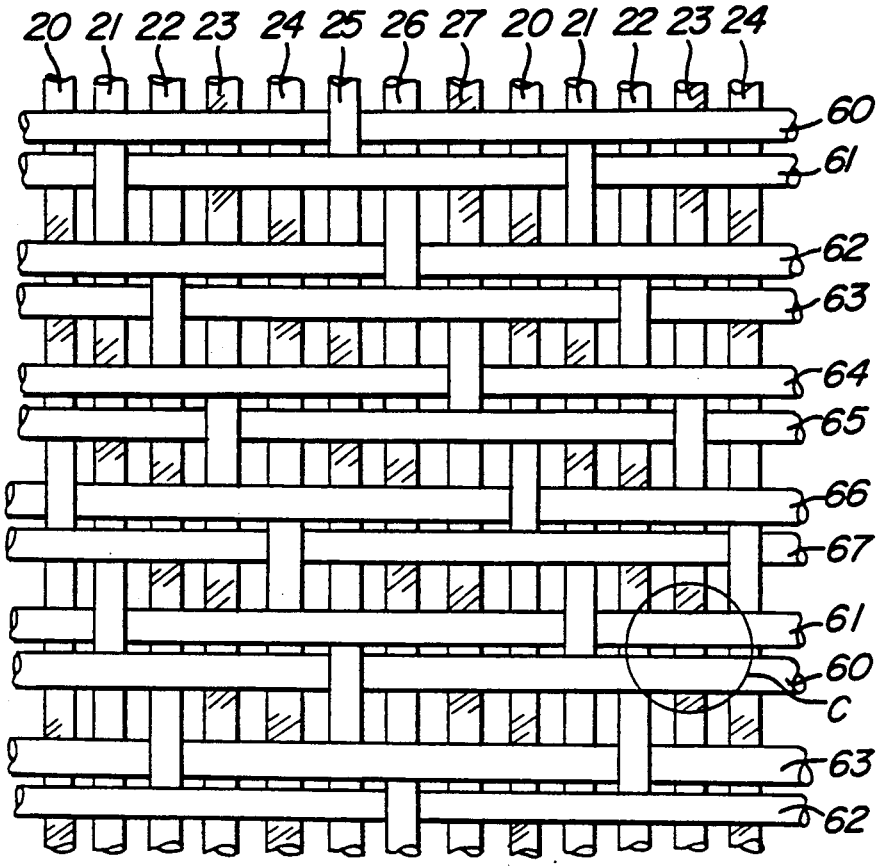
FIG. 6 is a plan view of the lower layer or running side, respectively, of the double web according to the invention, the upper layer or paper side, respectively, of which is shown in FIG. 4, wherein the circles a) and c) identify the position of the two layers with respect to one another.

From the plan view of the underside or running side of one embodiment of the forming wire according to the invention as shown in FIG. 6, which is related to the plan view of the upper side or paper side as shown in FIG. 4, wherein the relative positions of the two web layers with respect to one another are marked by the circles designated by a) and c), a further embodiment of the construction of the forming fabric can be gathered. This construction as characterized therein that the upper cross threads 41, 43, 45, 47, undercrossing and overcrossing alternatively pairs of the longitudinal threads of the first set 1 are each offset with respect to one another by a longitudinal thread of the first set 1 and that in addition to that the lower cross threads 60 to 67 overspan downwardly seven longitudinal threads following to one another of the second set 2 of longitudinal threads and all longitudinal threads of the first set 1 as seen from the underside of the web. Thus, the lower cross threads 60 to 67 on the running side form very long floatings increasing thereby further the available wear capacity or volume.

Figure 3:
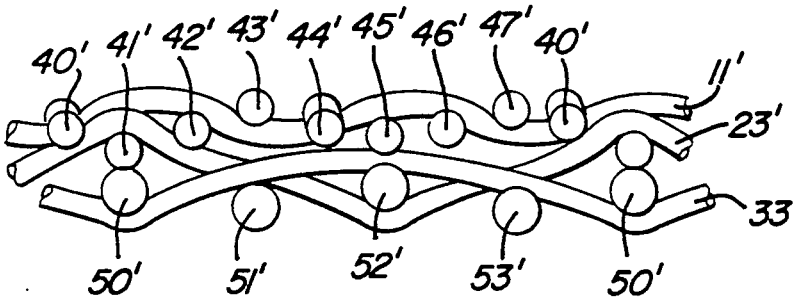
FIG. 3 is a sectional view along the longitudinal threads of the double web according to the invention, corresponding to the embodiments as shown by FIGS. 7 and 8.
Figure 7:
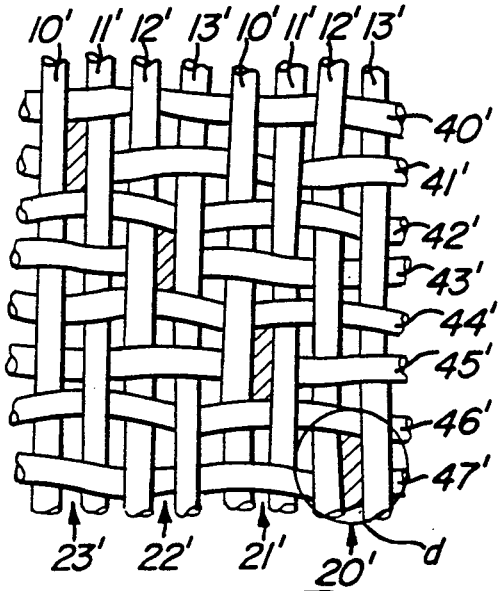
FIG. 7 is a plan view of the layer on the paper side showing a further embodiment of the double web according to the invention.
Figure 8:
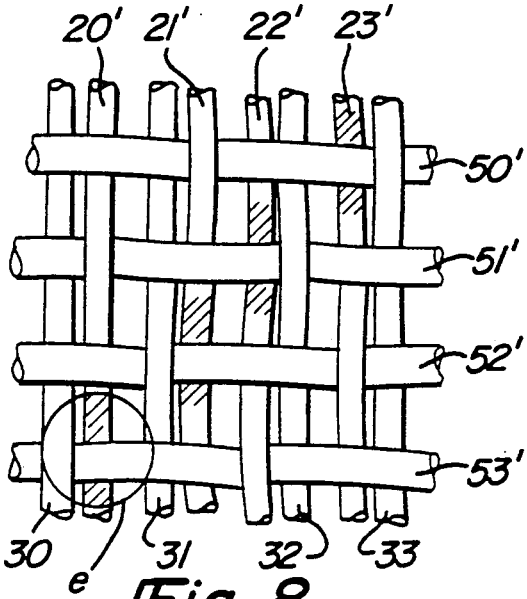
FIG. 8 is a plan view of the layer on the running side of the further embodiment of the double web as shown by FIG. 7, wherein the circles d) and e) identify the position of the two layers with respect to one another.

FIG. 3, 7 and 8 show a further embodiment of the forming wire providing the double web according to the subject invention, wherein a third set of longitudinal threads, consisting of the longitudinal threads 30 to 33 is used, which are interwoven only with the lower layer of cross threads 50′ to 53′. Thus, the three sets of longitudinal threads form together with the upper layer of cross threads 40′ to 47′ as well a repeating weave patterns, in which at least some of the upper cross threads 41′, 43′, 45′, 47′ of five longitudinal threads succeeding one another are undercrossed and thereafter three succeeding longitudinal threads are overcrossed. Two of the last longitudinal threads belong to the first set 1 and one to the second set 2 of the longitudinal threads, and the longitudinal thread of the second set overcrosses only one upper cross thread within weave pattern or repeat, respectively, whereas longitudinal threads of the first set overcross the weave pattern or repeat, respectively, two times two subsequently following upper cross threads.

FIG. 7 shows a further plan view of the upper layer or the layer on the paper side of an embodiment of the form wire comparable to the plan view of FIG. 4, in which those upper cross threads 41', 43', 45', 47' undercrossing and overcrossing alternatively pairs of the longitudinal threads of the first set 1 are each with respect to one another by two longitudinal threads of the first set 1 and those of the upper threads 40, 42, 44, 46; 40', 42', 44', 46' undercrossing and overcrossing alternatively the single longitudinal threads of the first set 1 are each with respect to one another by one longitudinal thread of the first set 1.

FIG. 8 the lower layer or layer of the running side of forming wire belonging to the upper layer or layer the paper side of the forming wire and disclosed by FIG. 7, wherein in both last mentioned FIGS. the circles designated by d) and e) characterize the position the two layers with respect to one another.

It goes w saying that the longitudinal threads may have diameters and may consist of different materials.

Moreover, in those cases, in which the longitudinal threads of the second set 2 of the forming wire according to the subject invention, provided with two or three sets of longitudinal threads may be at those locations 7 in which they overcross an upper cross thread tangent to a level positioned below that level which is tangented by the longitudinal threads of the first set 1 at those locations 8 (FIG. 2) in which these longitudinal threads of the first set overcross the upper cross threads. Under those circumstances the two levels may be distantly arranged with respect to another by at least 15% of the greatest diameter of the longitudinal threads 10 to 13, 20 to 23 of the first or second set, respectively.

In case of those embodiments of the forming fabric according to the subject invention being provided with the same or nearly the same number of longitudinal threads 20 to 23 of the second set 2 and longitudinal threads 10 to 13 of the first set 1, all longitudinal threads are moreover similar with respect to their diameters, a double fabric is formed, which could nearly be distinguished from a double layered fabric insofar as that souble fabric is provided with the known good characteristics of a double layered fabric, but having despite of a comparable thickness an essentially higher wear volume. This is because of the fact that not only the lower cross threads 50 to 53 can be completely worn but also the longitudinal threads 60 to 67 of the second set 2.

From the above can be gathered that forming fabrics according to the subject invention have an extended life time without incuring danger of cross rupture, because the longitudinal threads of the first set 1 are subjected to abrasion only then when the whole lower layer or cross threads and longitudinal threads is completely worn. Even then the longitudinal threads of the first set 1 are at least partly protected by the inwardly directed floatings of the upper cross threads.

What I claim is:

1. Double fabric as forming wire for the wet end of a paper making machine for dewatering and formation of a paper web, which wire consists of two sets of longitudinal threads and at least one upper and one lower layer of cross threads, wherein the first set of longitudinal threads are interwoven only with the upper layer of cross threads, and the second set of longitudinal threads are interwoven with the lower layer of cross threads as well as at least partly with the upper layer of cross threads, characterized therein that the two sets of longitudinal threads configure with the upper layer of cross threads a repeating weave pattern in which at least some of the upper cross threads are undercrossed by at least three subsequently following longitudinal threads and are thereafter overcrossed by at least three subsequently following longitudinal threads, wherein of the last mentioned at least three subsequently following longitudinal threads at least two belong to the first set and one belongs to the second set and the last mentioned longitudinal thread of the second set overcrosses only one upper cross thread within the weave pattern (repeat), whereas the longitudinal threads of the first set of longitudinal threads overcross within the weave pattern at least one time two subsequently following upper cross threads.

2. Double fabric according to claim 1, characterized in that the lower cross threads overspan downwardly three longitudinal threads of the second set succeeding one another as well as all longitudinal threads of the first set.

3. Double fabric as forming wire for the wet end of a papermaking machine for dewatering and formation of a paper web, consisting of three sets of longitudinal threads and at least one upper and one lower layer of cross threads, wherein the first set of longitudinal threads is interwoven only with the upper layer of cross threads, the second set of longitudinal threads is interwoven with both layers of cross threads, and the third set of longitudinal threads is interwoven only with the lower layer of cross threads, characterized in that the three sets of longitudinal threads are configuring together with the upper layer of cross threads a repeating weave pattern, in which at least some of the upper cross threads are undercrossed by at least three longitudinal threads succeeding one another and subsequently overcrossed by at least three longitudinal threads succeeding one another, wherein of the last mentioned longitudinal threads belong at least two to the first set and one to the second set of longitudinal threads, which one longitudinal thread of the second set overcrosses only one upper cross thread within the weave patter (repeat), whereas the longitudinal threads of the first set overcross at least once within the weave pattern two subsequently following upper cross threads.

4. Double fabric according to claim 3, characterized in that within the weave pattern another part of the upper cross threads alternately undercross and overcross the longitudinal threads of the first set.

5. Double fabric according to claim 3, characterized in that two subsequently following longitudinal threads, one of which belongs to the second set of longitudinal threads and the other one to the third set of longitudinal threads are not interwoven with the same cross threads of the lower layer.

6. Double fabric according to claim 3, characterized in that the longitudinal threads have different diameters and consist of different materials.

7. Double fabric as forming wire for the wet end of a paper making machine for dewatering and formation of a paper web, which wire consists of two sets of longitudinal threads and at least one upper and one lower layer of cross threads, wherein the first set of longitudinal threads are interwoven only with the upper layer of cross threads, and the second set of longitudinal threads are interwoven with the lower layer of cross threads as well as at least partly with the upper layer of cross threads, characterized therein that the two sets of longitudinal threads configure with the upper layer of cross threads a repeating weave pattern in which at least some of the upper cross threads are undercrossed by at least three subsequently following longitudinal threads and are thereafter overcrossed by at least three subsequently following longitudinal threads, wherein of the last mentioned at least three subsequently following longitudinal threads at least two belong to the first set and one belongs to the second set and the last mentioned longitudinal thread of the second set overcrosses only one upper cross thread within the weave pattern (repeat), where as the longitudinal threads overcross within the weave pattern at least one time two subsequently following upper cross threads, said double fabric further characterized in that the first set of longitudinal threads provides with the upper layer of cross threads a weave pattern, in which at least a part of the upper cross threads alternately undercross and overcross pairs of the longitudinal threads of the first set.

8. Double fabric according to claim 7, characterized in that within the weave pattern another part of the upper cross threads alternately undercross and overcross the single longitudinal threads of the first set.

9. Double fabric according to claim 8, characterized in that those cross threads of the upper cross threads which are alternately undercrossing and overcrossing the single longitudinal threads of the first set are each offset with respect to one another by one longitudinal thread.

10. Double fabric according to claim 7, characterized in that those of the upper cross threads undercrossing and overcrossing alternately pairs of the longitudinal threads of the first set are each offset with respect to one another by one longitudinal thread of the first set.

11. Double fabric according to claim 7, characterized in that those of the upper cross threads which are undercrossing overcrossing alternately pairs of the longitudinal threads of the first set are each offset with respect to one another by two longitudinal threads of the first set.

12. Double fabric as forming wire for the wet end of a paper making machine for dewatering and formation of a paper web, which wire consists of two sets of longitudinal threads and at least one upper and one lower layer of cross threads, wherein the first set of longitudinal threads are interwoven only with the upper layer of cross threads, and the second set of longitudinal threads are interwoven with the lower layer of cross threads as well as at least partly with the upper layer of cross threads, characterized therein that the two sets of longitudinal threads configure with the upper layer of cross threads a repeating weave pattern in which at least some of the upper cross threads are undercrossed by at least three subsequently following longitudinal threads and are thereafter overcrossed by at least three subsequently following longitudinal threads, wherein of the last mentioned at least three subsequently following longitudinal threads at least two belong to the first set and one belongs to the second set and the last mentioned longitudinal thread of the second set overcrosses only one upper cross thread within the weave pattern (repeat), where as the longitudinal threads overcross within the weave pattern at least one time two subsequently following upper cross threads, said double fabric further characterized in that the lower cross threads overspan downwardly seven longitudinal threads of the second set of longitudinal threads succeeding one another as well as all longitudinal threads of the first set as seen from the underside of the fabric.

13. Double fabric according to claim 12, characterized in that the longitudinal threads of the second set are at those locations in which they overcross one upper cross thread tangent to a level positioned below that level which is tangented by the longitudinal threads of the first set at those locations in which these longitudinal threads of the first set overcross the upper cross threads.

14. Double fabric according to claim 13, characterized in that the two levels are distantly arranged from one another by at least 10% of the greatest diameter of the longitudinal threads of the first or second set.

15. Double fabric according to claim 1, characterized in that the longitudinal threads have different diameters and consist of different materials.

16. Double fabric as forming wire for the wet end of a papermaking machine for dewatering and formation of a paper web, consisting of three sets of longitudinal threads and at least one upper and one lower layer of cross threads, wherein the first set of longitudinal threads is interwoven only with the upper layer of cross threads, the second set of longitudinal threads is interwoven with both layers of cross threads, and the third set of longitudinal threads is interwoven only with the lower layer of cross threads, characterized in that the three sets of longitudinal threads are configuring together with the upper layer of cross threads a repeating weave pattern, in which at least some of the upper cross threads are undercrossed by at least three longitudinal threads succeeding one another and subsequently overcrossed by at least three longitudinal threads succeeding one another, wherein of the last mentioned longitudinal threads belong at least two to the first set and one to the second set of longitudinal threads, which one longitudinal thread of the second set overcrosses only one upper cross thread within the weave pattern (repeat), whereas the longitudinal threads of the first set overcross at least once within the weave pattern two subsequently following upper cross threads, said double fabric characterized in that the first set of longitudinal threads provides with the upper layer of cross threads a weave pattern, in which at least a part of the upper cross threads alternatively undercross and overcross pairs of the longitudinal threads of the first set.

17. Double fabric according to claim 16, characterized in that the lower cross threads overspan downwardly three longitudinal threads of the second and third set succeeding one another as well as all longitudinal threads of the first set.

18. Double fabric according to claim 16, characterized in that those of the upper cross threads undercrossing and overcrossing alternately of the longitudinal threads of the first set are each offset with respect to one another by one longitudinal thread of the first set.

19. Double fabric according to claim 16, characterized in that those of the upper cross threads which are undercrossing and overcrossing alternately of the longitudinal threads of the first set are each offset with respect to one another by two longitudinal threads of the first set.

20. Double fabric according to claim 16, characterized in that the lower cross threads overspan downwardly seven longitudinal threads of the second and third set of longitudinal threads succeeding one another as well as all longitudinal threads of the first set as seen from the underside of the fabric.

21. Double fabric according to claim 16, characterized in that the longitudinal threads of the second set are at those locations in which they overcross one upper cross thread tangent to a level positioned below that level which is tangented by the longitudinal threads of the first set at those locations in which these longitudinal threads of the first set overcross the upper cross threads.

* * * * *